United States Patent [19]

Spangler

[11] Patent Number: 4,464,565

[45] Date of Patent: Aug. 7, 1984

[54] EXTENSIBLE TAPE HEATER

[76] Inventor: Glenn C. Spangler, 13645 Reeveston Rd., Houston, Tex. 77039

[21] Appl. No.: 475,732

[22] Filed: Mar. 16, 1983

[51] Int. Cl.[3] ..... H05B 3/02

[52] U.S. Cl. ..... 219/550; 219/535; 219/541; 219/542; 219/552; 338/316; 338/213; 174/111

[58] Field of Search ..... 219/532, 535, 536, 537, 219/550, 541, 542, 552, 544, 549; 338/213, 214, 273, 274, 316, 322; 174/885, 111, 138 J

[56] References Cited

U.S. PATENT DOCUMENTS

| | | | |
|---|---|---|---|
| 1,997,146 | 4/1935 | Hynes | 219/550 X |
| 2,379,317 | 6/1945 | Picciano | 338/316 X |
| 2,722,597 | 11/1955 | Steiner | 219/550 X |
| 3,036,187 | 5/1962 | Goldstaub et al. | 219/550 X |
| 3,694,628 | 9/1972 | McGuire et al. | 219/550 |
| 3,846,621 | 11/1974 | Roos | 219/550 |
| 4,241,292 | 12/1980 | Kreick et al. | 219/541 |

FOREIGN PATENT DOCUMENTS

| | | | |
|---|---|---|---|
| 411462 | 3/1925 | Fed. Rep. of Germany | 219/550 |
| 116307 | 8/1926 | Switzerland | 219/550 |
| 358182 | 10/1931 | United Kingdom | 219/550 |
| 449632 | 7/1936 | United Kingdom | 219/550 |

*Primary Examiner*—Volodymyr Y. Mayewsky

*Attorney, Agent, or Firm*—Dula, Shields & Egbert

[57] ABSTRACT

An elongated flexible resistance heating element includes a heat transmitting cover that is generally coextensive with the element. A resilient element is provided adjacent one end of the heating element to accommodate extension of the cover for use of the heater as desired without changing the length of the element or cover. The extensible tape heater of the present invention comprises an elongated flexible resistance wire heating element, a heat transmitting extendable cover arranged coextensive with the heating element, a substantially nonresistive wire connected about one end of the heating element, a spring surrounding the nonresistive wire and abutting the cover at one of its ends, a stop positioned about the non-resistive wire in spaced relation to the end of the cover, and a flexible sleeve extending over the spring.

1 Claim, 3 Drawing Figures

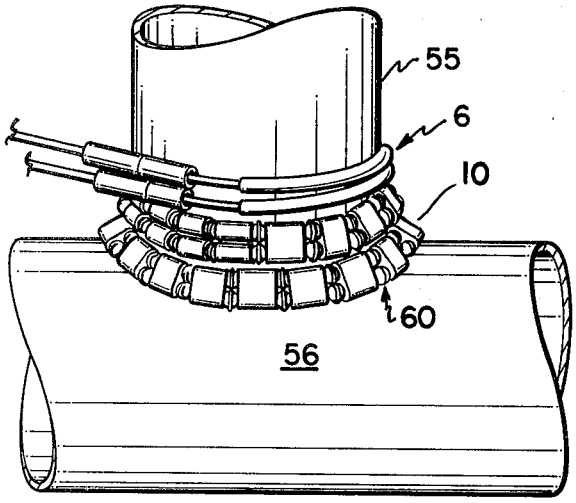
Fig. 1
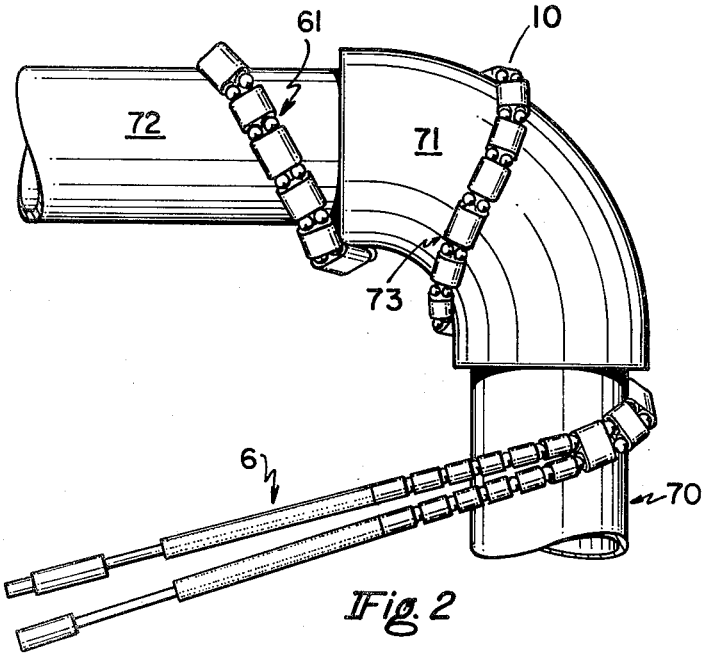
Fig. 2
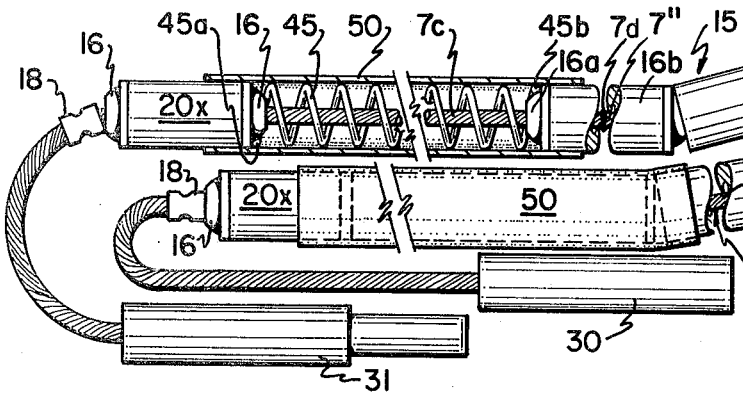
Fig. 3
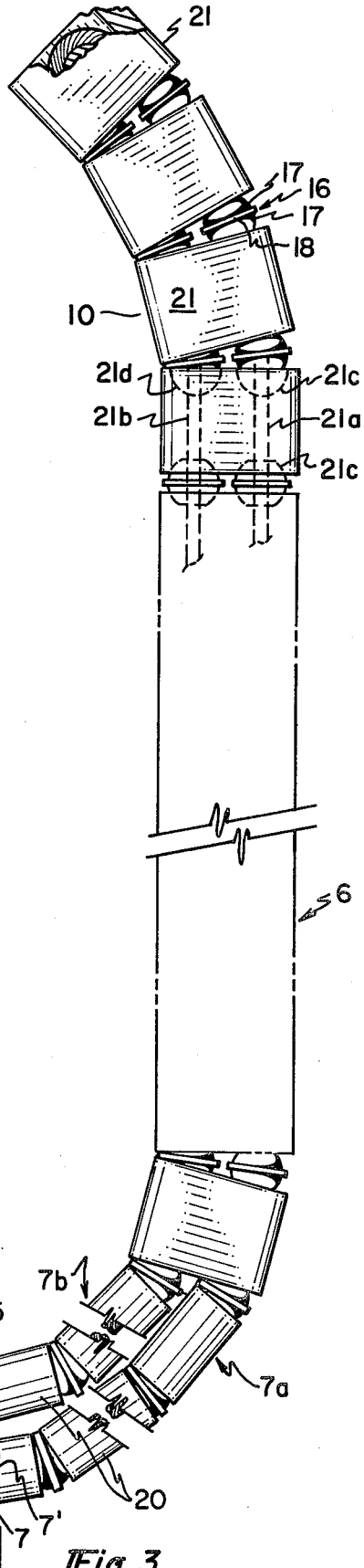

EXTENSIBLE TAPE HEATER

SUMMARY OF THE INVENTION

Various type electric surface heater assemblies have been heretofore provided for temporary application to a body surface for heating the surface preparatory to welding or for stress relieving a weldment after the welding operation. Generally speaking, such heating assemblies are provided in various fixed lengths and include a flexible heating element of a well known type formed by a resistor conductor with terminal ends thereon for connection to an electrical power source. The cover means for the heating element is not generally flexible. Prior art cover means has been arranged to attempt to accommodate flexing of the resistor heating element, and to try to accommodate flexing of the heating element sufficiently so that the heater may be employed on successive adjacent plates or surfaces which have different curvatures, or different diameters, or where some plates are curved and some are straight or flat. Such arrangements have not proved entirely satisfactory. The problem of accommodating the heater to various surfaces is substantially increased where, as in most situations, the tape heater is of a fixed length as is the cover therefor so that the degree of flexibility is severely restricted.

Where the cover comprises a plurality of ceramic or refractory members such as brittle ceramic beads which are strung on the resistor element in end to end relation, it has heretofore been customary to break some of the beads out of the heater cover to accommodate flexing of the heater to fit it in close proximity to varying curvatures, diameters or arrangements of surfaces on which the heater is employed. One other solution has been to remove the terminal ends from the resistor heating element and then to unstring the desired number of ceramic beads and then to replace the electrical connectors on the resistor heating element. In other situations, the length of the resistor heating element is increased by securing additional lengths of resistor heating element thereto with a suitable number of ceramic or refractory beads or members strung thereon in end to end relation to increase the total length of the heater.

Similarly, where the heating element cover is of other material, the cover material or resistor heating element must be physically altered in some manner to attempt to fit the heater to varying shapes and curvatures.

The present invention overcomes the above difficulties and eliminates the necessity of either breaking or changing the physical arrangement of the heater regardless of type. It eliminates, in a ceramic bead type cover, for example, beads or changing the lengths of the resistance heater element or removing the beads from the resistor element. The present invention enables the heater to accommodate to varying configurations, changes in diameter and surfaces without either increasing the length of the cover or the length of the heating element.

It also eliminates the disadvantages of breaking beads in a fixed length heater, or the time consuming and expensive operation of either increasing the length of the resistor heating element or removing the terminal ends and unstringing the beads from the resistor heating element.

Other objects and advantages of the present invention will become more readily apparent from a consideration of the following description and drawings.

BRIEF DESCRIPTION OF THE DRAWINGS

FIG. 1 illustrates the use of the invention on a surface having a changing diameter or size wherein the heater of the present invention expands or extends to accommodate such changes;

FIG. 2 is a view of the heater of the present invention illustrating it employed on successive surfaces which are straight and curved; and FIG. 3 is a view of a preferred form of the present invention.

DESCRIPTION OF THE PREFERRED EMBODIMENT

Attention is first directed to FIG. 3 of the drawings wherein the tape heater of the present invention is referred to by the numeral 6 and is shown as including a resistance heating element 7 which is formed of a continuous wire, preferably a nickle chrome wire of well known type, configuration and composition. Cover means 10 for the resistance heating element 7 in the form of a continuous wire comprises a plurality of ceramic or refractory material beads referred to generally at 15 which include the beads 16 having curved or convex end surfaces 17 which are separated by the circumferential rib 18. A central opening is provided through the bead 16 for receiving the resistor heating element 7. The beads 16 serve as spacers for the round, tail beads 20 which have a central opening therethrough for receiving the wire 7, and each of their ends is recessed around the opening for receiving the curved or convex end surfaces 17 of the spacer beads 16. The spacer beads 16 also serve to space the flat ceramic members or beads 21 each of which includes spaced openings **21*a* and 21*b* extending longitudinally through the beads 21 for receiving the wire resistor heating element therein as will be described. It will be noted that one of the ceramic beads 16 having such configuration as shown in the drawings is positioned adjacent each end of each of the members 21, and each of the members 21 is provided with a pair of concave recesses 21*c* and 21*d* at each end for receiving one of the convex surfaces 17 of the ceramic bead 16 therein. This accommodates some flexing between the beads 16 and the ceramic flat beads 21, but in an ordinary heater tape employing such arrangement, the flexibility of the ceramic beads and hence flexibility of the resistor wire heating wire heating element 7 is limited since the beads are secured in position at the end of the cover 10** formed by the beads in a manner well known to those skilled in the art.

The tape heater 6 of the present invention is formed by stringing it through one of the flat ceramic members represented at 21' and doubling it back on itself so as to provide two resistance wire heating elements 7' and 7'' of substantially the same length as shown in the drawings. Thereafter, the beads 16 and the beads 21 are strung in end to end relation on the adjacent wires 7' and 7'' to form a tape heater element of desired extent. Not all of the ceramic beads are illustrated in FIG. 3, but it can be appreciated that they will be of the same configuration and arrangement as that described hereinabove.

The portions referred to generally at **7*a* and 7*b* of the tape heater 6 may be referred to as the tail portions, and it will be noted that these portions of the tape heater 6 are formed by the beads 16 and the round tail beads 20** previously described. The tail portions *7a* and *7b* are of any suitable desired extent. Each resistance heater wire strand 7' and 7" is soldered or otherwise electrically connected with a nonresistive wire strand illustrated at *7c* which extends from its point of connection represented at *7d* within each tail strand *7a, 7b* through each spring 45 to connectors 30 and 31 secured with the end of each wire *7c*. This prevents damage by heat to each spring 45. The connectors 30 and 31 are each connected to one of the end portions of the nonresistive wire means *7c* by any suitable means well known to those skilled in the art, and the members 30 and 31 provide a connection means for connecting the tape heater 6 of the present invention with any electrical power source as may be desired for supplying electrical power to the resistance heating elements 7' and 7" formed by continuous wire 7.

The nonresistive wire means *7c* is shown as being covered from approximately *7d* secured thereon to the connector means 30 and 31, respectively. Abutted against each of the clip means 18 is one of the beads, such as the bead 16, which in turn abuts a round, tail bead 20*x* as shown.

Before securing the connector means 30 and 31 with each of the so called nonresistive wire portions *7c*, suitable spring means 45 are positioned over each of the nonresistive wire portions *7c* as shown in FIG. 2 with an end of the spring means 45 abutting against the bead 16 which, along with the bead 20*x* and clip 18, comprise stop means against which the end 45*a* of the spring 45 rests. One end 45*b* of the spring 45 rests against the last bead 16*a* comprising or forming the tail bead portions *7a* and *7b* of the cover 10. A sleeve cover 50 of any suitable electrically insulative material or fabric such as a silicone coated Fiberglas may be provided to cover each of the springs 45 to assist in manipulating the cover 10 for positioning the heater 6 of the present invention on surfaces of varying configurations as will be described. Sleeve 50 is an elastomeric material that is fastened or secured by adhesive forces or mechanical forces at each of its ends to the outer surfaces of bead 20*x* and bead 16*b*.

After the beads 16 and 21 have been stepwise and simultaneously strung on wire portions 7' and 7" to form a heater of desired length, the beads 16 and 20 are then strung separately on wire portions 7' and 7" to form the separate tail portions *7a* and *7b*. Springs 45 are positioned over each nonresistive wire portion *7c* and their ends abutted against the last bead 16 on each 7' and 7". Bead 20*x* and its end beads 16 are then strung on each 7' and 7" and the retaining clip 18 is then secured by crimping or otherwise on each 7' and 7". Connectors 30 and 31 are then secured adjacent the end of each wire *7c*.

In FIG. 1, the tape heater of the present invention is shown as being positioned over a weldment which is not visible in FIG. 1 which connects the tubular member 55 to the tubular member 56. It can be appreciated that at the point of juncture of the members 55 and 56 and the weldment connecting them together, the radius of curvature varies at such weldment. Heretofore, it has been substantially difficult, if not impossible, to position a tape heater formed of ceramic beads and a resistance heating element as that disclosed herein in sufficient close proximity to the weldment without first breaking some of the beads or otherwise physically modifying either the length of the heater element or the length of the cover comprising the beads.

As can be seen in FIG. 1, this problem is overcome by the present invention merely by compressing the spring 45 of the present invention so as to enable the beads forming cover 10 to separate and thus extend the cover 10. This in turn accommodates flexing of the cover 10 and wires 7' and 7" as illustrated in FIG. 3 of the drawings and as represented at 60 in FIG. 1 of the drawings. In other words, shifting of the ceramic beads on the heater is accommodated by the springs 45 on each wire 7' and 7" so that the heater 6 can be positioned in close proximity to the juncture of 55 and 56 and then secured in position adjacent the surface such as illustrated in FIG. 1 even though it is a surface of varying curvature.

Similarly, in FIG. 2, it will be noted that the beads are shown as being extended or spaced by reason of compressing the spring 45 to accommodate such extension and spacing in order that the heater element may be positioned around the tubular member 70 and then the elbow 71 and then the portion 72. It will be noted that at 73 the elements are again shown as being expanded or separated, which separation is effected by compression of the springs 45 to enable the heater 6 of fixed length to conform with and closely fit the adjacent surfaces of changing configuration. The tape heater 6 may then be secured in position by any suitable means such as wire or other means well known to those skilled in the art to retain it in position to accommodate the desired heating of the members 70, 71 and 72.

The resilient means 45 or spring means 45 accommodates spreading apart of the ceramic beads. This enables the wires 7' and 7" to be flexed at far greater angles than would be otherwise possible so that the heater 6 of the present invention may be accommodated to fit in close proximity adjacent various curved surfaces and in close proximity to changing curved surfaces without changing the length of the wire element or without changing the length of the cover by removal of beads, or by shortening or lengthening of the element or the cover.

The foregoing disclosure and description of the invention are illustrative and explanatory thereof, and various changes in the size, shape and materials as well as in the details of the illustrated construction may be made without departing from the spirit of the invention.

What is claimed is:

1. A tape heater for securing in close proximity to a surface including:

a. an elongated flexible resistance wire heating element;

b. heat transmitting extendable cover means generally coextensive with said element, said cover means being of electrically insulative material, wherein said resistance wire heating element is a continuous wire that extends from one end of said cover means to the other end and then doubles back on itself to said one end of said cover means wherein;

c. substantially nonresistive wire means connected about one end of said element;

d. spring means surrounding said nonresistive wire means and abutting said cover means at one of its ends, wherein said cover means comprises a plurality of ceramic beads strung in end to end relation on said wire whereby compression of said spring means enables said beads to spread apart so that the heater may be secured in close proximity to a surface of varying diameter and configuration without changing the length of said element and without removing any of said beads;

e. stop means positioned on said nonresistive wire means in spaced relation to the end of said cover means which abuts one end of said spring means;

f. said spring means having its other end in abutting relationship with said stop means; and g. flexible sleeve means extending over said spring means and fastened about said cover means.

* * * * *